US009550103B1

(12) United States Patent
Zivkovic

(10) Patent No.: US 9,550,103 B1
(45) Date of Patent: Jan. 24, 2017

(54) SELECTABLE BOUNDARY FENCING STRIP

(71) Applicant: Zivkovic Modern Fencing Equipment, Inc., Wellesley Hills, MA (US)

(72) Inventor: Branimir Zivkovic, Wellesley Hills, MA (US)

(73) Assignee: Zivkovic Modem Fencing Equipment, Inc., Wellesley Hills, MA (US)

( * ) Notice: Subject to any disclaimer, the term of this patent is extended or adjusted under 35 U.S.C. 154(b) by 292 days.

(21) Appl. No.: 14/507,345

(22) Filed: Oct. 6, 2014

Related U.S. Application Data

(60) Provisional application No. 61/887,315, filed on Oct. 4, 2013.

(51) Int. Cl.
*A63F 9/00* (2006.01)
*A63B 69/02* (2006.01)

(52) U.S. Cl.
CPC ..... *A63B 69/02* (2013.01)

(58) Field of Classification Search
None
See application file for complete search history.

(56) References Cited

U.S. PATENT DOCUMENTS 3,920,242 A 11/1975 Reith et al.
4,030,731 A 6/1977 Delcayre
4,271,622 A 6/1981 Tippmann et al.
5,069,450 A * 12/1991 Pyle ..... A63B 24/0021 473/415
5,836,853 A * 11/1998 Marciano ..... A63B 69/02 482/12
5,976,039 A * 11/1999 Epel ..... A63C 19/02 473/490
6,669,601 B2 12/2003 Marciano
2001/0023218 A1* 9/2001 Marciano ..... A63B 71/10 482/12
2007/0263380 A1 11/2007 Hamar et al.
2008/0312002 A1* 12/2008 Cengarle ..... A63C 19/08 472/92
2009/0020953 A1 1/2009 Hallsten
2010/0146719 A1 6/2010 Swessel et al.
2012/0010002 A1* 1/2012 Hart ..... A63B 69/02 463/47.1
2012/0302301 A1* 11/2012 Homsi ..... A63B 24/0021 463/2

* cited by examiner

*Primary Examiner* — Seng H Lim
(74) *Attorney, Agent, or Firm* — Loginov & Associates, PLLC; William A. Loginov

(57) ABSTRACT

A selectable boundary fencing strip that includes a plurality of light assemblies, in communication with the scoring controller and console. Light assemblies are embedded at predetermined locations within the fencing strip so as to indicate boundary lines, playing lines, hits, yellow cards and the command to fence. The strip includes a plurality of light sources, each controllable from a master control. The conductive top surface is perforated so that the light sources project through. Light sources in the strip provide visual cues for commencing to fence, warning cards and hits that are visible to spectators, fencers and the referee. In a further embodiment, the illustrative fencing strip is constructed and arranged with a plurality of panels along the sides of the strip that can be marketed for advertising sponsorship revenue. This revenue can be used to pay for the strip and/or underwrite activities of the fencing organization.

10 Claims, 14 Drawing Sheets

SELECTABLE BOUNDARY FENCING STRIP

RELATED APPLICATIONS

This application claims the benefit of U.S. Provisional Application Ser. No. 61/887,315, filed Oct. 4, 2013, entitled SELECTABLE BOUNDARY FENCING STRIP, the entire disclosure of which is herein incorporated by reference.

FIELD OF THE INVENTION

This invention relates to equipment used in the sport of fencing, and more particularly to electrically conductive fencing strips used to record scores in competition.

BACKGROUND OF THE INVENTION

Fencing is an ancient and highly regarded athletic activity. It is a competitive and strenuous sport for two contestants ("fencers") at a time. As shown, by way of example in FIG. 1 in the prior art, a fencing competition involves two contestants (fencers) 110, 120 wearing appropriate protective clothing 112, 114 and face masks 114, 124, respectively. Each contestant 110, 120 uses a blade 116, 126, that is appropriate to the particular type of fencing (foil, epée, etc.).

In competition, the fencers are judged by a referee 131 who monitors the fencer's activities as each competitor attempts to score touches on key areas of the other one's body with his or her blade. In competition, and in various types of fencing, the fencers employ blades having electrical contacts on their tips that respond to a touch (for example, epee and foil). Other blades, such as saber, can employ a conductive blade surface. The fencer can also employ special garments 112, 122 that include an electrically conductive material (for use in saber, for example). The material is electrically connected to a body cord (not shown). This body cord is also connected to the fencer's weapon.

The body cord extends inside the fencer's sleeve to a connection point inside the guard of the weapon. The body cord extends down the fencer's back to a connection with wires 118, 128, which extend from each respective fencer as shown. Touchs by each fencer 110, 120 on various parts of the opponent's body transmit signals through respective wires 118, 128. The wires 118, 128 are each connected to a respective spring-wound reel (not shown) located at each opposing end of the strip, beyond the boundary lines of competition. These reels take up and pay out each wire 118, 128 while maintaining tautness as the fencers move up and down an elongated platform knows as a fencing strip 130, and are connected to the main electronic scoring device/console (described below).

When constructed from aluminum (or another metallic) sheet, the fencing strip 130 includes an exposed top surface 132 that is electrically conductive. It is often constructed from aluminum sheet that can include perforations or other structures thereon. The fencing strip is constructed in segments that are joined at joint lines 134 for easy storage and subsequent assembly during a match. Appropriate mechanical fasteners and connectors can be used to join the segments together. Sometimes, the segments are elevated on a set of lengthwise stringers 136.

The touch signals from each fencer are transmitted through the reel wires 118, 128 via a connecting cable system 150 to a central scoring console 160. The scoring console 160 can include a time clock 162 and a pair of score pylons 164 and 166. The pylons 164, 166 correspond to each fencer's scoring activities. In one embodiment, each pylon includes a discrete colored light 170 (for example, a red light on one pylon and a green light on the other pylon) to make it easier for the referee 131 and audience to identify which contestant scored a touch. An alphanumeric score window 172 can also be displayed on each pylon 164, 166, indicating each fencer's current score.

The top plate surface 132 is conductive because the strip generally represents an area in which no score is given in response to a touch. Thus, the entire surface of the strip is conductive and provides a ground plane connected to the reels. When a blade conductively contacts the strip surface during competition, the control system in the console 160 recognizes the touch as one with the strip and registers no score. Thus, it is important to be able to differentiate touches that simply contact the strip. The conductive surface in combination with an interconnection to scoring console enables such differentiation.

Because the rules of fencing are fairly sophisticated, the referee cannot simply rely upon the scoring console 160 to determine the outcome of a match. Rather, he or she must also pay constant attention to the fencer's movements to ensure that all touches have been properly scored and that the fencer has stayed with the bounds of the strip at all times.

A fully constructed fencing strip can extend at least 17 meters. This length causes the referee to move constantly with the back and forth activity over reasonably long distances to closely track the movement of the (often quickly moving) fencers. As the fencers move to either respective end of the strip 130, the referee is now faced with a fairly long-distance view of the console 160. As such, the referee must continually divide his or her attention between the fencers in front of him or her, and the more-distant, and off-angle, scoring console 160. In short, the referee must constantly turn his or her head back-and-forth, and simultaneously readjust his or her focus to keep up with the match. Only through this constant head-turning can the referee keep an eye on the score, while at the same time continually returning his or her attention to the fencers.

Accordingly, it is desirable to provide a system that enables a referee (and audience) to keep his or her eyes generally on both the fencers and the score at the same time, regardless of where the fencers are positioned along the fencing strip. It is also desirable to provide improvements to a fencing strip that better utilize the available space and possibly smooth the transition between the raised stringers (that can be needed in the strip's design) and the floor.

SUMMARY OF THE INVENTION

This invention overcomes the disadvantages of the prior art by providing a fencing strip that includes a plurality of light assemblies, in communication with the scoring controller and console. A selectable boundary fencing strip is comprised of a plurality of segments of panels of similar size and shape, each provided with a conductive perforated top surface and supported by a plurality of support stringers; a plurality of light sources located within each segment of panel, each being constructed and arranged to indicate each of a plurality of different scoring events, the light sources each being located beneath the conductive perforated top surface, the conductive top surface being perforated so that the light sources project through, and their light can be viewed through the perforations, the light sources being interconnected with a scoring control of the electronic scoring system; and a plurality of pre-set illuminated boundaries that can be selected and modified. The light sources in the strip are arranged to provide visual illumination cues for commencing to fence, warning cards and hits. The sides of the strip are provided with a plurality of panels for advertising sponsorship. The fencing strip provides a plurality of settings for athletes of various ages and sizes. The light sources are constructed and arranged to project at provide pre-set boundaries for the various settings for athletes of various sizes and ages. A senior setting describes an active area of 14 meters in length and 1.5 meters in width for a fencer over 16 years of age and of largest stature. A junior setting describes an active area of 11.20 meters in length and 1.5 meters in width for a fencer between the ages of 10 and 15 year and of middle stature. A cadet setting describes an active area of 11.20 meters in length and 1 meter in width for a fencer between the ages of 7 and 9 years and of smallest stature. A plurality of segments of panels can be provided with a panel that can be used to display information. The information displayed is advertising and sponsorship information. A universal dolly for containing and transporting a disassembled selectable boundary fencing strip comprising of an upright box that is provided with lockable casters and a removable scoreboard. A method for paying for a selectable boundary fencing strip is comprised of acquiring the strip by one of payment in full, rental agreement or deferred payment; and selling placement of advertising sponsorship panels to underwrite the payment. A method for providing funding to a fencing organization comprising of acquiring a selectable boundary fencing strip with open information panels; and selling placement of advertising sponsorship panels to underwrite the organization activities. A method for conducting fencing activity comprising of transporting a disassembled fencing strip within a dolly; removing segments of the disassembled fencing strip from the dolly; connecting the segments of the fencing strip to create a fencing strip of a desired length; and connecting the lighting within each segment to a removable score panel.

BRIEF DESCRIPTION OF THE DRAWINGS

The invention description below refers to the accompanying drawings, of which.

DETAILED DESCRIPTION

Figure 1:
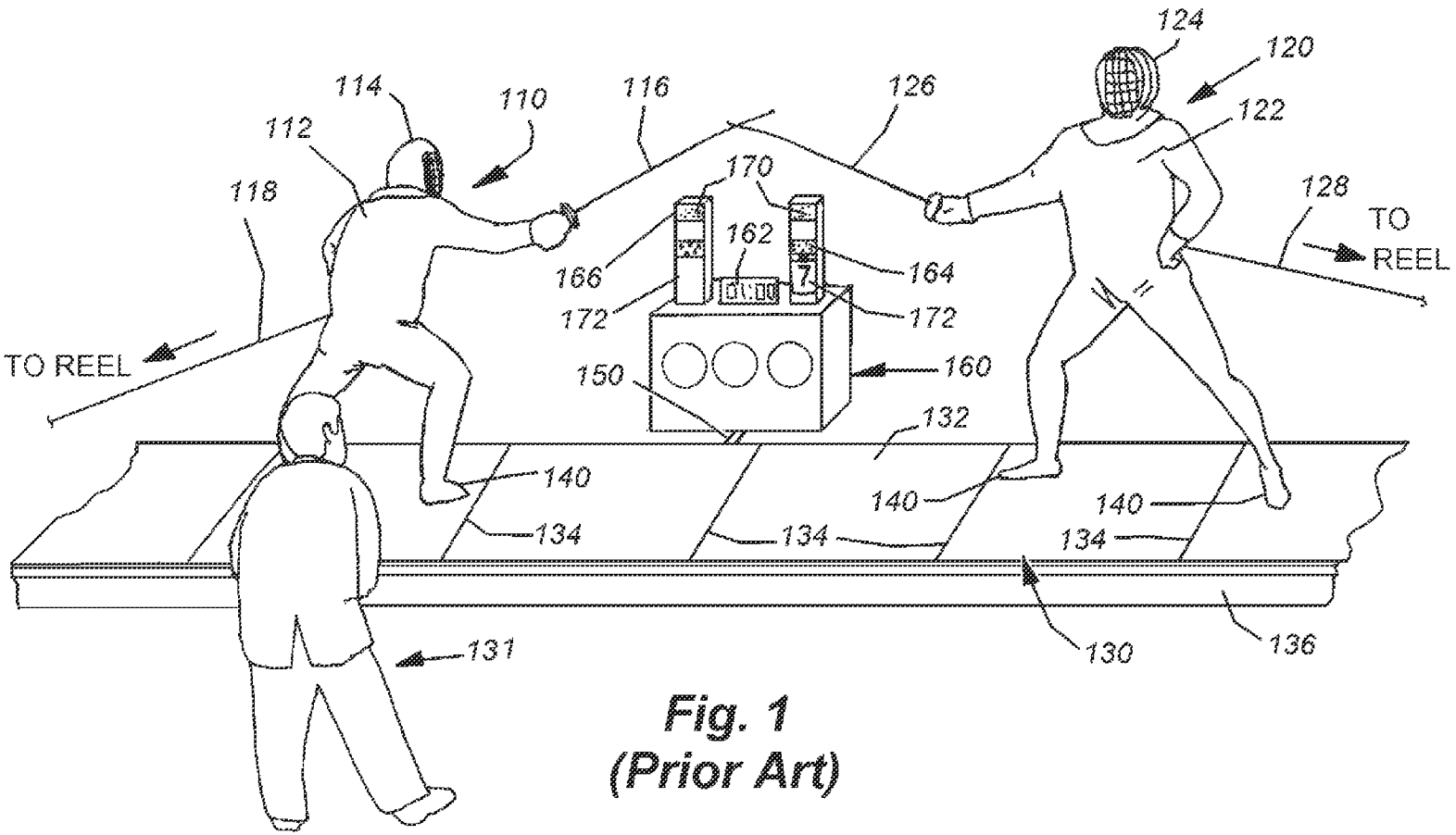
Fig. 1 (Prior Art)
FIG. 1, already described, is a partial perspective view of a fencing strip according to the prior art, which enables electronic scoring of competition through an electronic scoring console, and showing a pair of fencers engaged in a match with a referee observing.
Figure 2:
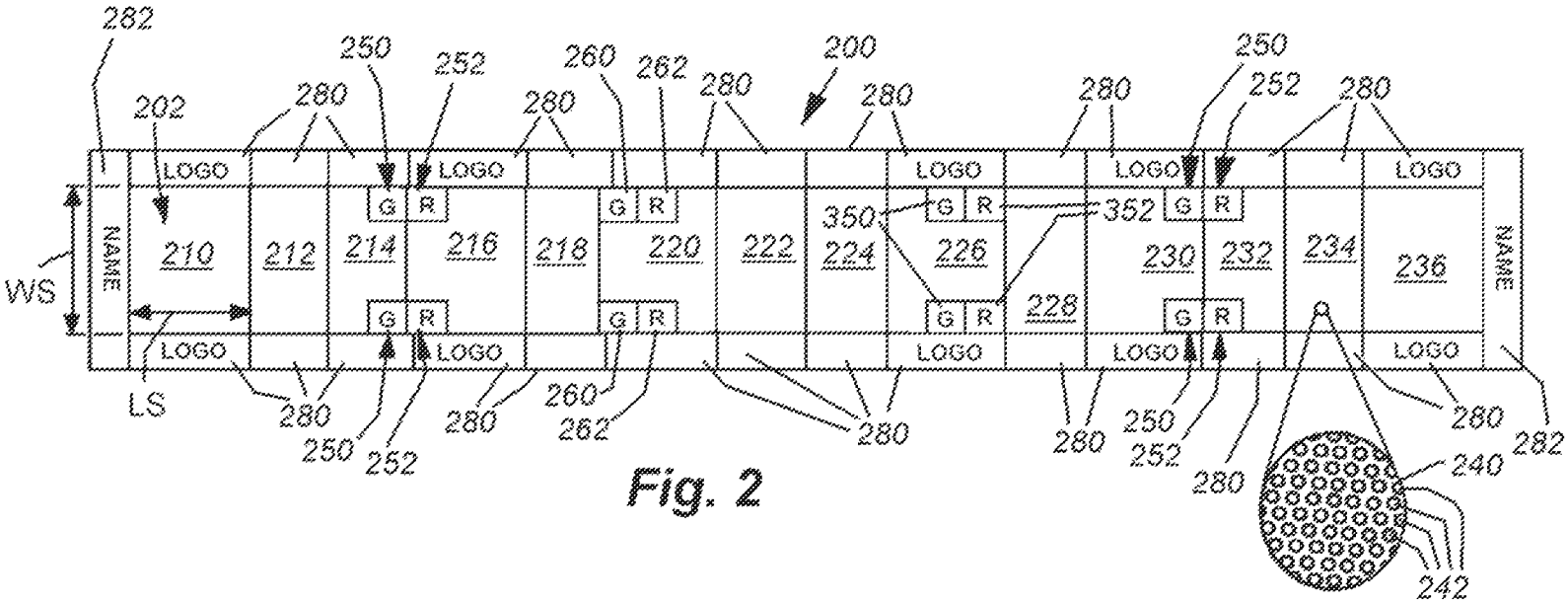
FIG. 2 is a plan view of a full-length, assembled fencing strip having integrated, embedded scoring light assemblies mounted on various segments along the length of the strip, and optional logo/information-containing panels/placards according to an illustrative embodiment of this invention.

An illustrative fencing strip according to an embodiment is shown in FIG. 2. The interior portion of the strip 202 (the flat portion that is stood upon) includes fourteen segments 210, 212, 214 216, 218, 220, 222, 224, 226, 228, 230, 232, 234 and 236. These segments are panels of approximately similar size and shape. Each panel has a length LS of approximately 122 centimeters and a width WS of approximately 151 centimeters. Note that these segment dimensions are exemplary and the size of individual strip segments in all dimensions can vary significantly. Likewise, the number of segments used to construct the fencing strip 200 is highly variable—thus, partially dictating the length of individual strip segments in the assembly. In this example, the total length of the inner portion of the strip (defined generally by the supporting subsurface covered by the conductive top surface) 202 is approximately 17 meters. However, depending upon the guidelines of the particular competition (e.g. world championship, Olympic, national championship, etc.) the overall length and width of the interior strip 202 is highly variable. Thus, typical length of the strip interior 202 varies from approximately 14 to 18 meters and width varies form approximately 1.5 to 2 meters.

In the illustrative embodiment, the top surface comprises a sheet of perforated aluminum alloy having a thickness of approximately 3 millimeters. These perforations are shown in further detail in the magnified window 240 of FIG. 2. The depicted perforations 242 are between approximately 1 millimeter and 5 millimeters in diameter. However, other perforation dimensions are expressly contemplated. The adjacent perforations 242 are separated by a minimum spacing distance of approximately 2 millimeters to 4 millimeters. The underlying subsurface (described further below) comprises a 1.6 centimeter thick particle or fiberboard sheet material, such as a commercially available melamine laminate. Appropriate en garde lines, 2-meter lines, and other regulation markings can be painted or applied along the top surface of the strip on appropriate segments thereof. Segments are designed to assemble together using any acceptable securing mechanism including screwed-down clamps that run between each of the two subsurface pieces at their joint (see below).

Figure 3:
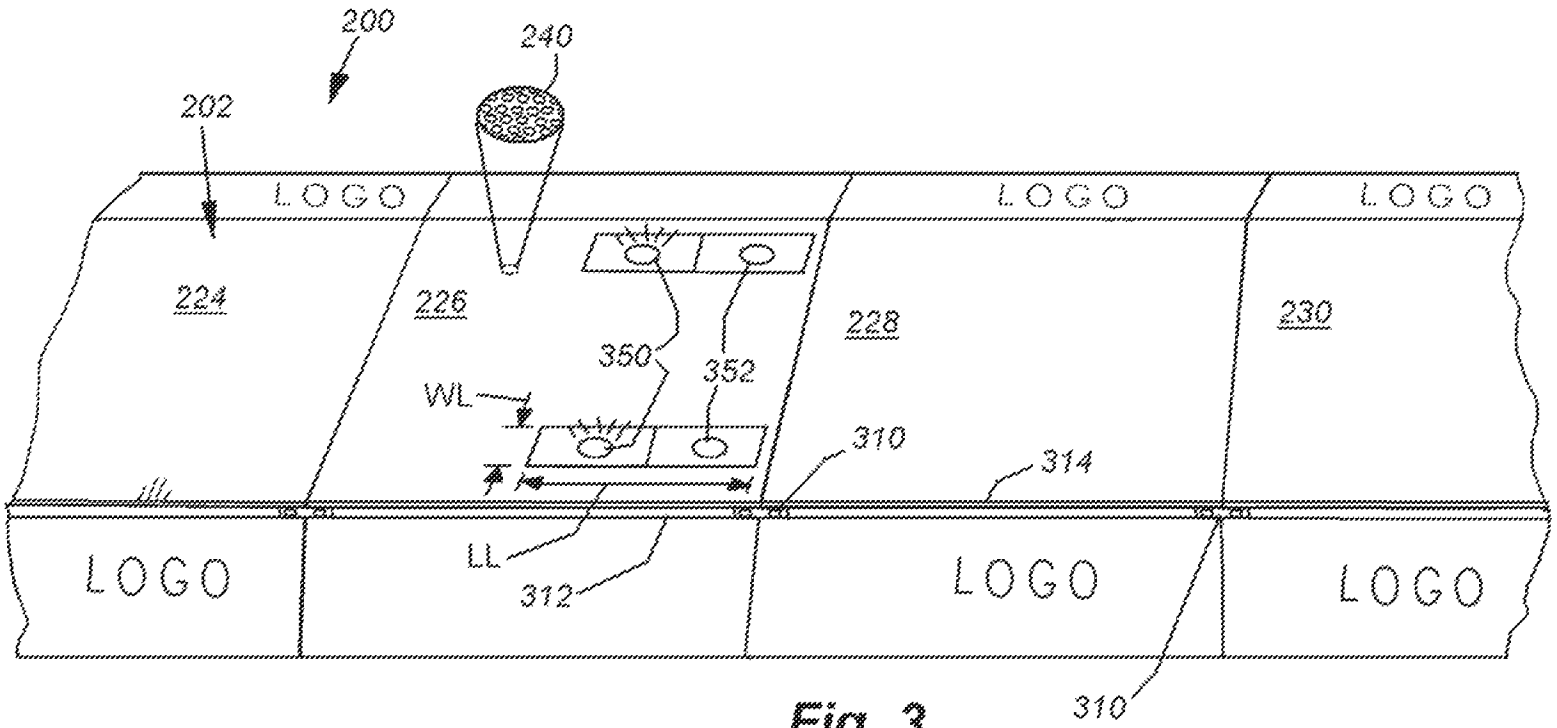
FIG. 3 is a more-detailed partial perspective view of the fencing strip of FIG. 2 showing placards and embedded scoring light assemblies according to the illustrative embodiment.
Figure 4:
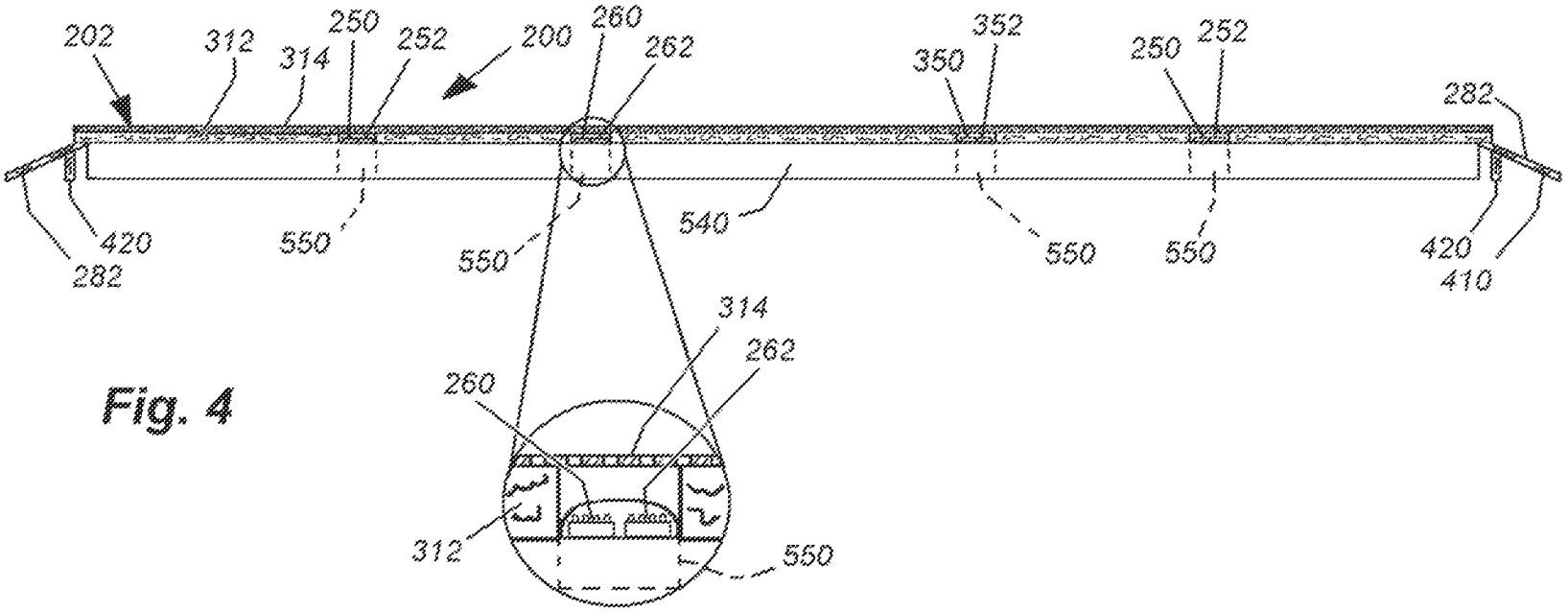
FIG. 4 is a side view of the fencing strip of FIG. 2 with placards removed to expose an outside support stringer.
Figure 5:
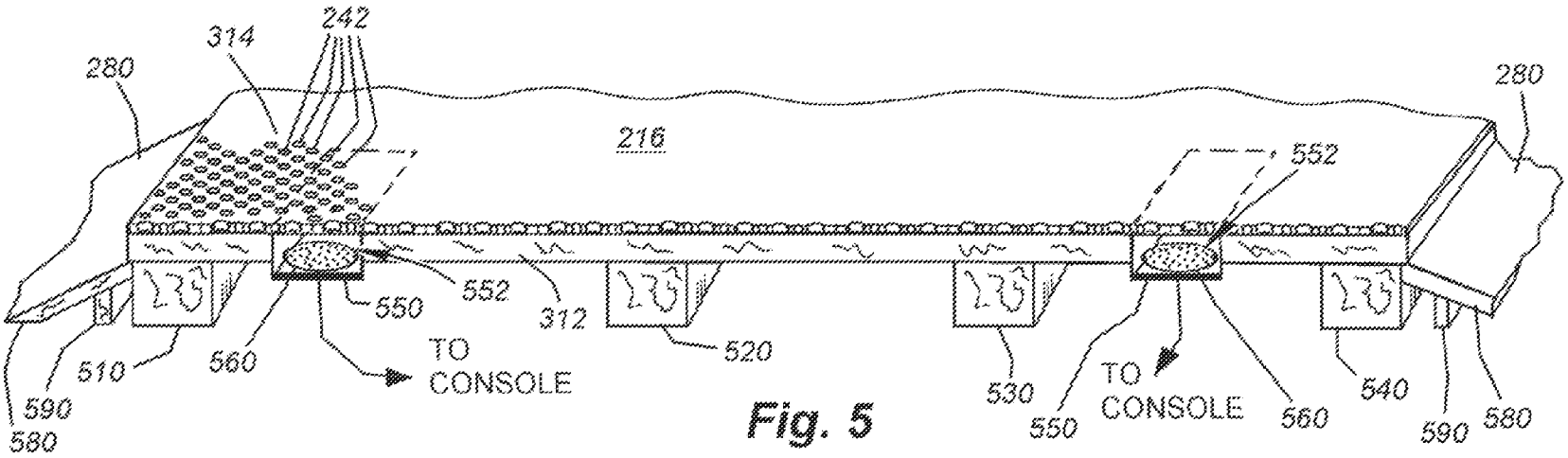
FIG. 5 is a widthwise cross section of the fencing strip of FIG. 2 taken through the scoring light assemblies.

As further described in FIG. 3, the adjoining strip segments (examples herein being 224, 226, 228 and 230 are shown in further detail joined together with appropriate clamps 310 attached between the joints on panels along the subsurface 312. The conductive, perforated top surface 314 is shown sandwiched together with the subsurface 312. The top surface and subsurface can be joined together using screws, adhesives or any acceptable fastening system. In general, the combination of melamine subsurface 312 and metal top surface 314 creates a laminate composite with relatively good durability and high strength. The sandwiched top surface and subsurface of each of the segments is supported on a set of stringers, as shown in FIGS. 4 and 5. The stringers 510, 520, 530 and 540 are spaced in a widthwise direction at approximately even intervals to evenly distribute the load on the top surface/subsurface. In this embodiment, there are four stringers, each 2-4 centimeters tall and approximately 4 centimeters in width. Thus, the overall height of each segment (and the resulting assembled strip) from the floor to top surface is approximately 5.5 centimeters. The stringers can be continuous, along all or part of the strip's length, or preferably, can be broken up and permanently adhered to the individual segment's subsurfaces. The stringers are positioned so as to allow wells or buckets 550 to be disposed within selected segments. With particular reference to FIGS. 4 and 5, the buckets 550 are mounted beneath rectangular slots 552 cut through the melamine subsurface 312. This allows the interior of each of the buckets 550 to be exposed directly to the underside of the conductive metal sheet surface 314. As such, the perforations 242 allow for a predetermined degree of optical communication between the outside environment and the interior of each bucket 550. Each of the buckets 550 contains one or more lighting elements 560. These lighting elements can be any acceptable light source including a high-output LED panel (as depicted in FIG. 5), incandescent bulbs, fluorescent or gas-discharge bulbs, or a combination of such light sources. The perforations 242 allow the light sources to be clearly viewed through the top surface 314 when they are illuminated.

Note that the use of stringers in then illustrative embodiment is at least in part to facilitate the mounting of light assemblies beneath the subsurface as described herein. Where light assemblies are constructed with particularly low-profile light elements (such as certain types of LED panels), then the height of the stringers can be minimized, or they can be omitted entirely. However, as described below, the use of raised stringers facilitates the inclusion of downwardly angled, information-containing placards, which can be beneficial for sponsorship and advertising purposes in certain embodiments to be described below.

Referring to FIG. 3, a pair of light sources 350 and 352 are disposed in a lengthwise-side-by-side relationship along. The light sources can both be mounted on a single segment as shown, or can be divided between two adjoining segments (for example panels 214 and 216). In this embodiment, the two separate light sources are each a different color. One color can be green and one color can be red (or any other color combination can be used). Referring to FIG. 2, in this embodiment the color green is represented by the letter G for each light and the color red represents the letter R for each light. As shown in FIG. 3, one set of light sources 350 has been lit, thereby allowing their light to be viewed through the perforations on the surface 314. Because the light buckets are relatively small in dimensions (for example, having a width WL of approximately 5-15 centimeters and a length LL of approximately 10-30 centimeters, the slot in the underlying subsurface melamine does not unduly compromise the structural integrity of the strip. In addition, the slots cut through the subsurface for these light buckets are located on or near the widthwise edges of the strip 202, thereby reducing the degree of contact with the fencers feet (since the fencers will tend to remain relatively centered on the strip). By providing slots in the subsurface while maintaining an unbroken, perforated top surface, no compromise of electrical contact occurs even though the lights are clearly visible therethrough.

It should be clear to one of ordinary skill that the lights are designed to report the prevailing score with each light in a pair (350, 352, for example) representing a particular fencer. In this embodiment, and as shown in FIG. 2, four spaced-apart locations along the strip are chosen for the placement of light pairs. On each far end of the strip, a respective light pair 250 and 252 is provided. In addition, two light pairs (lights 350, 352 described above and lights 260, 262) are also provided closer to the center. The actual center of the strip continues to be served by the console itself.

It should also be clear that the number and placement of light pairs is highly variable. In this example similar lights are provided on each widthwise edge to afford a good view from either side of the strip. In alternate embodiments, lights can be centered on the strip or placed on only one side thereof. Likewise, a larger or greater number of lights can be mounted on the strip. For example, in one alternate embodiment, every segment can include a light assembly for standardization of components. Some segments can be activated, depending upon the user's preferences. The light elements themselves are highly variable, as well. In an alternate embodiment, the light assemblies can take up less area on the strip by combining two colors in one light source. This can be achieved using a multi-color LED panel that can be controlled to project each of a plurality of different light colors. In addition, as shown in the magnified view of FIG. 4, the light elements can be covered by a clear dome. This dome can include two different colored filters so a single color (white) light can be projected in the appropriate color. In this manner two white sources can be used and they appear either green (or blue) or red (or yellow) due to the effects of the translucent filter mounted over the light.

Figure 6:
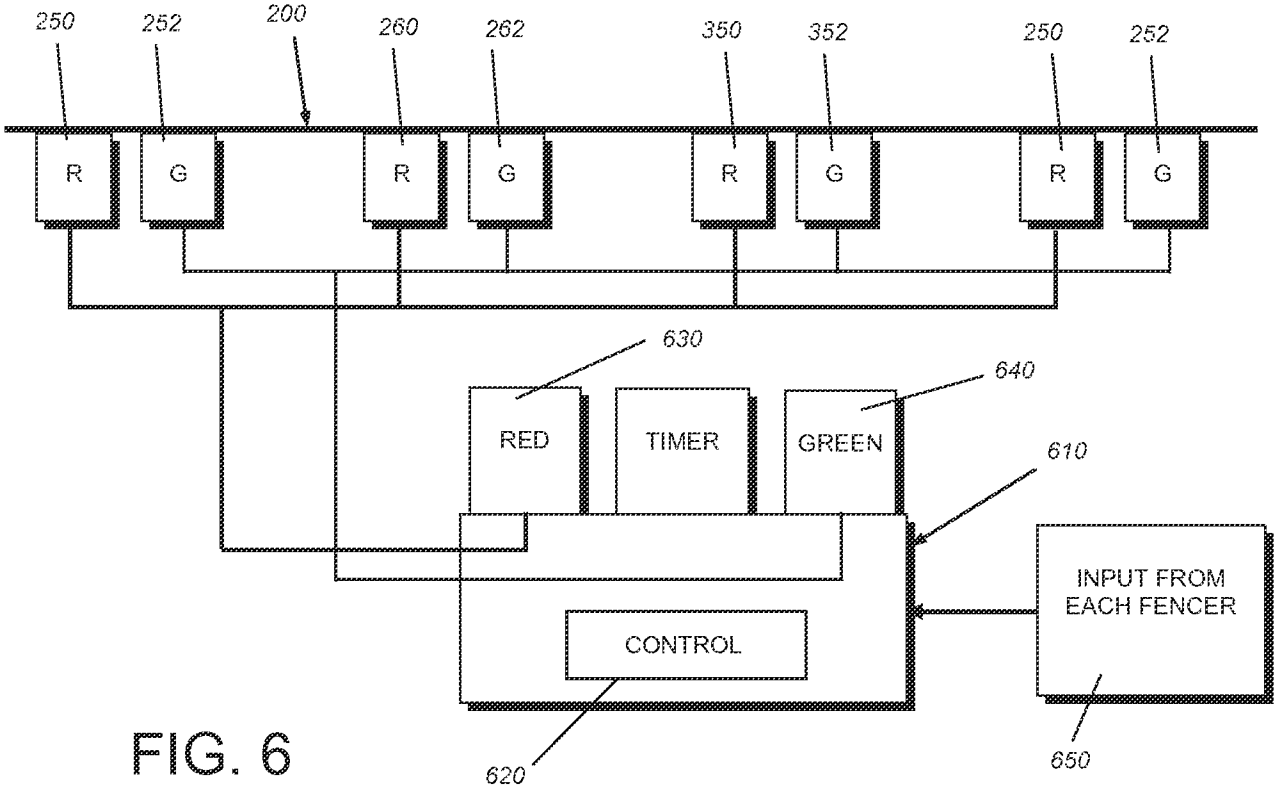
FIG. 6 is a schematic block diagram showing the interconnection of the control and scoring console with the embedded scoring light assemblies located along the length of the illustrative fencing strip in accordance with an embodiment of this invention.

Control of the embedded scoring lights is relatively straightforward. As shown in FIG. 6, the score console 610 includes a control block 620 that provides either a red or green scoring light 630 or 640 respectively based upon he relative input from each fencer 650. The red scoring light 630 is connected in parallel with each red light 250, 260 and 350 embedded in the fencing strip 202. Likewise, the green scoring light 640 is connected in parallel with each green light 252, 262 and 352 embedded in the strip 202. Appropriate amplifiers, voltage-reduction circuits and other needed switching circuitry, and/or voltage/current handling functions can be implemented in the control block 620 as appropriate. The control block 620, and/or any of these circuits can be housed in the console 610, provided within the buckets for each light source or some combination of these placements. The control block 620 can be instructed by wired and/or wireless input, either directly or remotely.

Having described the novel embedded scoring light arrangement for the illustrative fencing strip 200, reference is now made again generally to FIGS. 2-5, where a novel arrangement of information-containing placard 280, 282 is now be described in further detail. The placards 280 are located along the lengthwise edges of the central strip 202 while two end placards 282 are located on opposing ends of the strip 202. In this embodiment, the placards comprise ramps that can include appropriate trademark, advertising, promotional or public interest information (symbolized generally by the term "LOGO" and/or "NAME". The placards can be preprinted with such information or can receive appropriate removable cards, using conventional framing techniques or self-adhesive decals. It should be noted that the inventive placard arrangement described herein clearly provides a new and useful form of advertising and sponsorship revenue for fencing events and athletic programs. The placards 280, 282 also naturally render the appearance of the strip 200 more aesthetic covering the outer stringers 510, 514 (FIG. 3) and rendering the overall appearance of the strip more streamlined, and grounded to the floor.

As shown more particularly in FIGS. 4 and 5, each placard 282, 280 defines a durable top surface 410, 580 (respectively), constructed from a durable fibrous material, polymer or other sheet-like material. Each placard's top surface 410, 580 extends outwardly and downwardly from the strip at an approximate angle of 5-20 degrees with respect to the ground. The placard surface 410, 580 contains sufficient area to provide highly visible information. As shown the length of each placard matches that of the segment. In the case of lengthwise placards 280, that length is approximately 122 centimeters. The end placards 282 are more than 150 centimeters—owing to the width of the internal strip portion 202. The widthwise dimension of placards (i.e. how far they extend away from the strip edge) is highly variable. In one embodiment, this widthwise extension is between approximately 20 and 40 centimeters, but the actual dimension is highly variable. As particularly detailed in the cross section of FIG. 5, the inward-directed ends of each placard (placards 280 being shown) pass under an overhanging of subsurface 312 and conductive top surface 314 that extends past the adjacent outer stringer 510 and 540. This arrangement provides a clean appearance at the transition between the strip interior 202 (the flat portion that is stood upon), and the outwardly extending placards. A similar overhang is shown at the lengthwise ends of the strip in FIG. 4 with the end placards 282 passing thereunder. A variety of other techniques for securing or engaging the edges of the strip are also contemplated. In an alternate embodiment, the placards can be constructed so that they mate somewhat flushly against the top surface 314 of the strip interior 202. To maintain the chosen upward angle relative to the floor surface, each placard 282, 280 includes a small post member 420 and 590 (respectively), which allows it to maintain the upward angle. The post member 420, 590 is located along the width of each placard at a location that insures it will remain firmly engaged against the overhanging lip of the subsurface 312 and top surface 314. Hook-and-loop fasteners, magnets, or other removable fastening mechanisms (not shown) can also be used conventionally between the inward-directed ends of the placards and the strip interior 202 to further secure each placard to the lip if desired. In this embodiment, the placards are sized to match the length of each strip segment. In alternate embodiments, longer placards can be used with fewer breaks therebetween.

Figure 7:
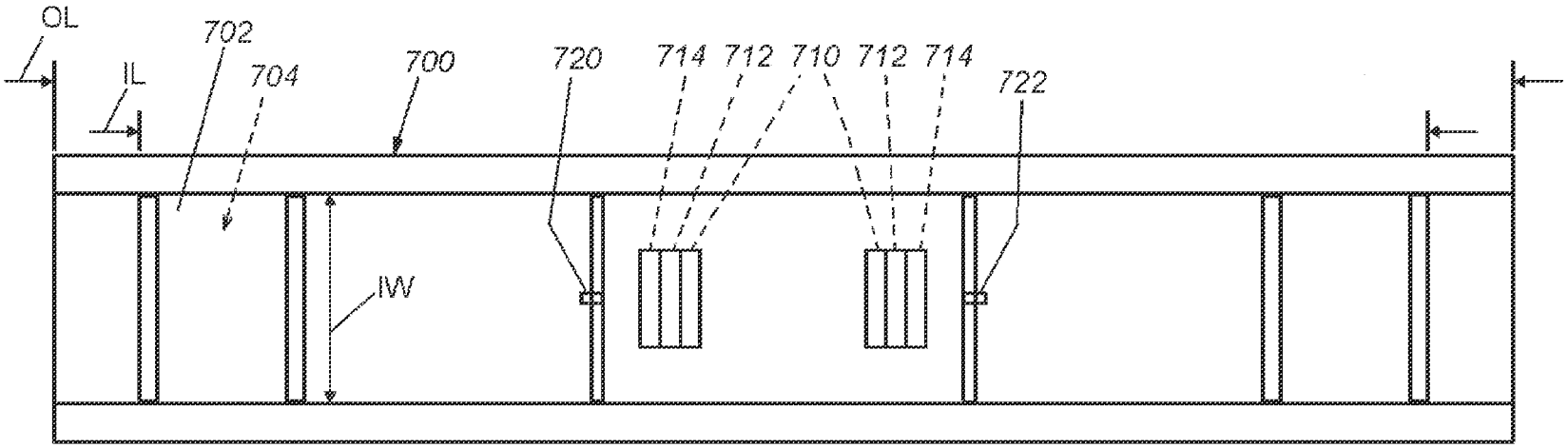
FIG. 7 depicts a top view of a selectable boundary fencing strip, according to an illustrative embodiment.

In another embodiment, a fencing strip 700 is shown in FIG. 7. In the illustrative embodiment, the top surface 702 comprises a sheet of perforated aluminum alloy having a thickness of approximately 3 millimeters. There is a supporting subsurface 704. The underlying subsurface (described further below) comprises a 1.6 centimeter thick particle or fiberboard sheet material, such as commercially available melamine laminate. In general, the combination of melamine subsurface 704 and metal top surface 702 creates a laminate composite with relatively good durability and high strength. The subsurface contains one or more lighting elements. These lighting elements can be any acceptable light source including a high-output LED panel, incandescent bulbs, fluorescent or gas-discharge bulbs, or a combination of such light sources. Perforations of between 1 and 2 millimeters in the top surface allow the light sources to be clearly viewed through the top surface 702 when they are lit.

In this example, the total length OL of the inner portion of the strip (defined generally by the supporting subsurface covered by the conductive top surface 702) is approximately 17 meters. However, depending upon the guidelines of the particular competition (e.g. world championship, Olympic, national championship, etc.) the overall length IL and width IW of the interior strip is highly variable, as will be set forth more fully below. Thus, typical length of the strip interior varies from approximately 14 to 18 meters and width varies form approximately 1.5 to 2 meters.

Appropriate en garde lines, 2-meter lines, and other regulation markings can be painted or applied along the top surface of the strip on appropriate segments thereof. Segments are designed to assemble together using any acceptable securing mechanism including screwed-down clamps that run between each of the two subsurface pieces at their joint. This provides for mobility and that provides transportation of the strip to various locations and venues for temporary and/or permanent emplacement.

Lighting elements 710, 712 and 714 are located in the subsurface 704. Each of these lighting elements has a plurality of colored lighting elements arrayed in a strip across the width of the strip. The lighting elements can be controlled from a control panel (not shown) that is actuated by a scorer. In an embodiment, lighting elements 710, 712 and 714 are of different colors. In the illustrative embodiment, lighting elements 710 are the "Fence" lights and are green. These lights remain on while the fencers take their respective en garde positions, located near positions 720 and 722. When the command to fence is given, the green lighting elements 710 are switched off and fencing can commence. This extinguishment of lights is a visual cue that reduces the potential for a mistaken start and does not rely on fencers wearing protective headgear hearing an audible command to start. It has been observed that this is a frequent source of mistakes and re-starts. Spectators can also see the illuminated lights in the strip and their extinguishment serves as a visual cue to those people as well. The selectable boundary fencing strip is constructed and arranged to provide a plurality of light sources, each being constructed and arranged to indicate each of a plurality of different scoring events, the light sources each being located beneath the conductive top surface, the conductive top surface being perforated so that the light sources project through, and their light can be viewed through the perforations, the light sources being interconnected with a scoring control of the electronic scoring system.

Lighting elements 712 provide visual cues for a yellow card award for a rules foul on the part of a fencer. A yellow light can be provided as a cautionary light, based on the long-standing use of yellow as a cautionary lighting cue for travel. This cue can be seen by the participants and spectators as well and does not require the viewers to shift their attention from the fencers to the scoreboard.

Lighting elements 714 provide visual cues for a hit. In an embodiment, the lighting provides a red light. This cue can be seen by the participants and spectators as well and does not require the viewers to shift their attention to the scoreboard. It is expressly contemplated that the order of visual cues for lighting elements 710, 712 and 714 can be varied, and that the lighting colors used can be varied.

Figure 8:
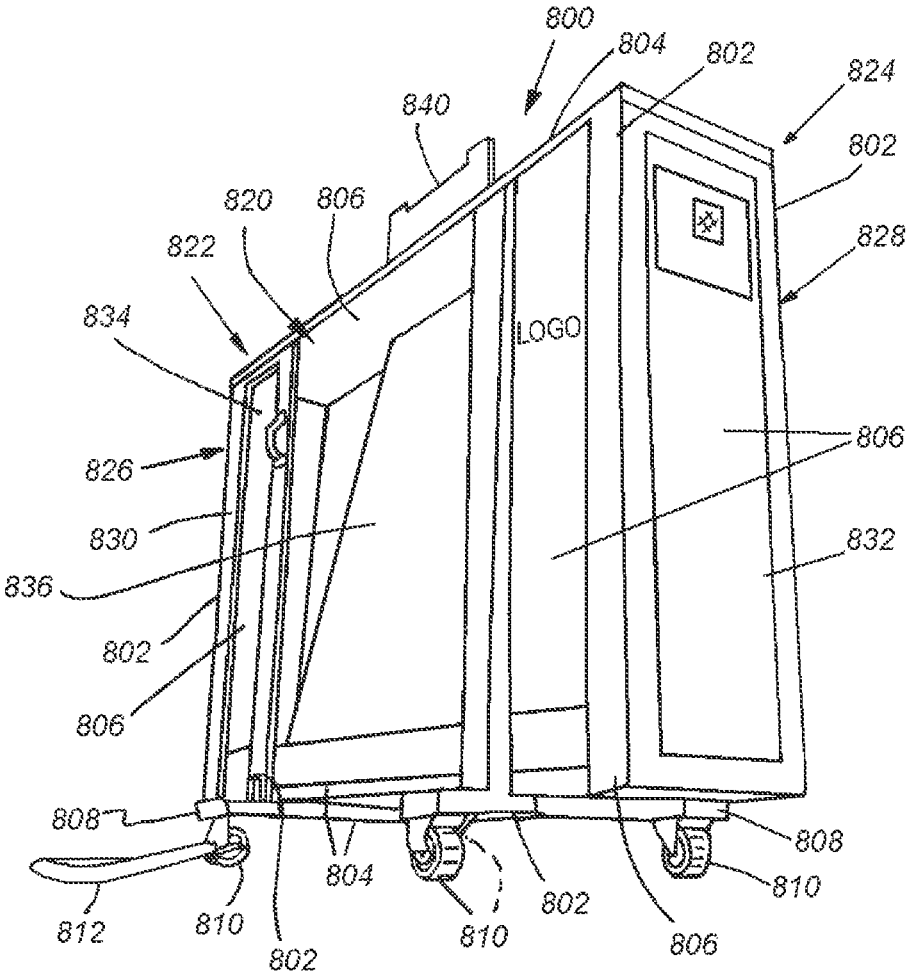
FIG. 8 is an end on perspective view of a universal dolly for the selectable boundary fencing strip in a loaded configuration, according to an illustrative embodiment.

In another embodiment, the fencing strip can be disassembled into smaller portions, each approximately 2 meters long and with a total weight of approximately 500 pounds. FIG. 8 shows a universal dolly 800, a transportation carrier for a disassembled strip that can also provide a scoring display and display surfaces. The dolly can also provide storage for the disassembled strip. The dolly 800 has a weight of approximately 100 pounds (45 kilograms) in an embodiment. The illustrative dolly is an upright rectilinear box. The vertical supports 802 and horizontal support members 804 are constructed of wood (for example, pine). The surface elements 806 are composed of a plywood product. In an embodiment, the plywood has a thickness of approximately one half inch. In other embodiments, the dolly can be constructed of metal products (for example, sheet steel), a combination of woods and metals, or other materials that impart rigidity, enclosure and support. In further embodiments, the width of the plywood can be thinner or thicker. Lateral bottom supports 808 are constructed to support the dolly and provide a base for a plurality of casters 810. In an embodiment, the dolly is provided with four casters 810, each of which can be locked and unlocked. A come along pull rope is attached to a caster to facilitate a person in pulling and maneuvering the dolly. In other embodiments, the dolly is constructed and arranged with a towing pintel mount for connection to a tractor, forklift or other vehicle for towing operations.

The dolly has an opening 820 in each of the sides 822, 824. The openings 820 can be covered by a removable cover panel (not shown). The ends 826, 828 of the dolly are provided with hinged doors 830, 832 that extend along the entire end and provide access to the interior of the dolly. The dolly can be provided with one or more handles 834 attached for ease in movement. The dolly is constructed and arranged to support contents of at least 500 pounds.

In an embodiment, a score board is removably mounted on the top portion of the dolly. The board is electronic and is provided with attachment points for electric cables to connect with external power sources and to the control panel (not shown). A disassembled strip 836 is located within the interior of the dolly in a loaded configuration.

Figure 9:
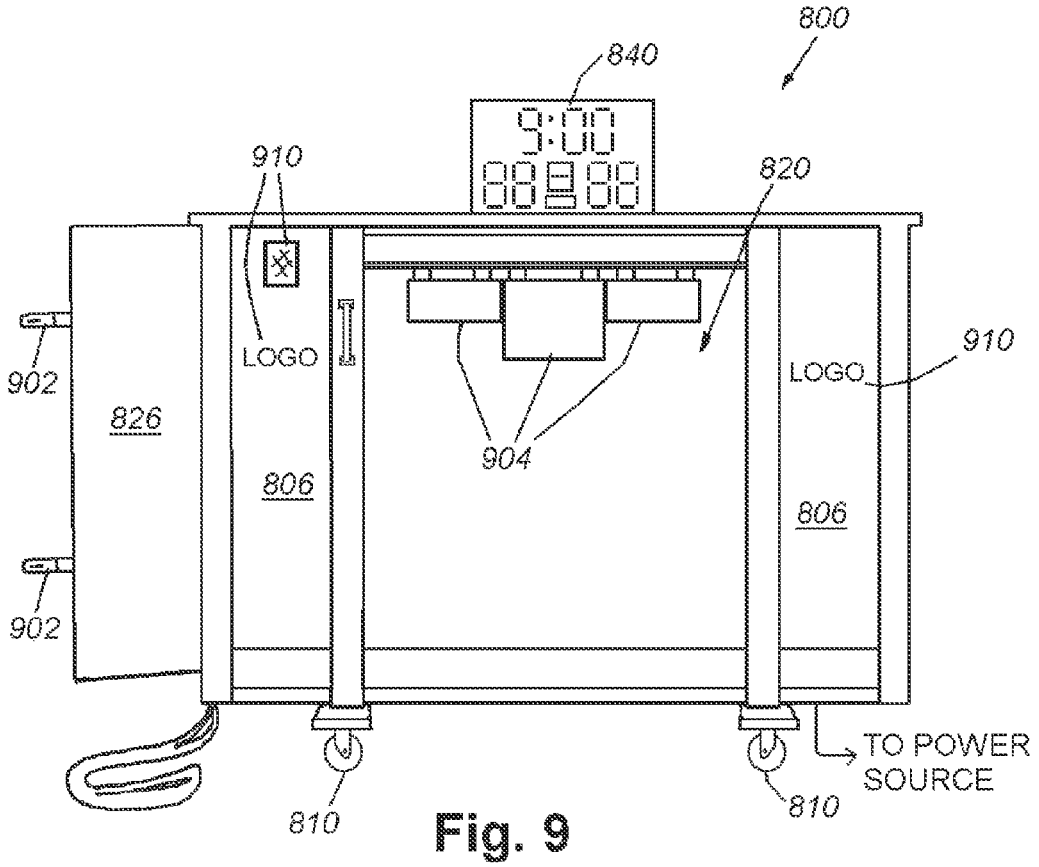
FIG. 9 is a side view of the universal dolly in an unloaded configuration, according to the illustrative embodiment.

FIG. 9 shows the dolly 800 with the strip removed and in an unloaded configuration. The scoreboard 840 is visible on the top. Side door 826 is open and the casters 810 are locked to prevent movement. Locking hasps 902 on the door provide for locking of the door when the dolly is loaded or not in use. A plurality of event-related sheets and/or notices 904 are shown as being displayed within the opening. It is further contemplated that surfaces 806 can be used for event-related materials and/or logos 910 or corporate sponsorships.

Figure 10:
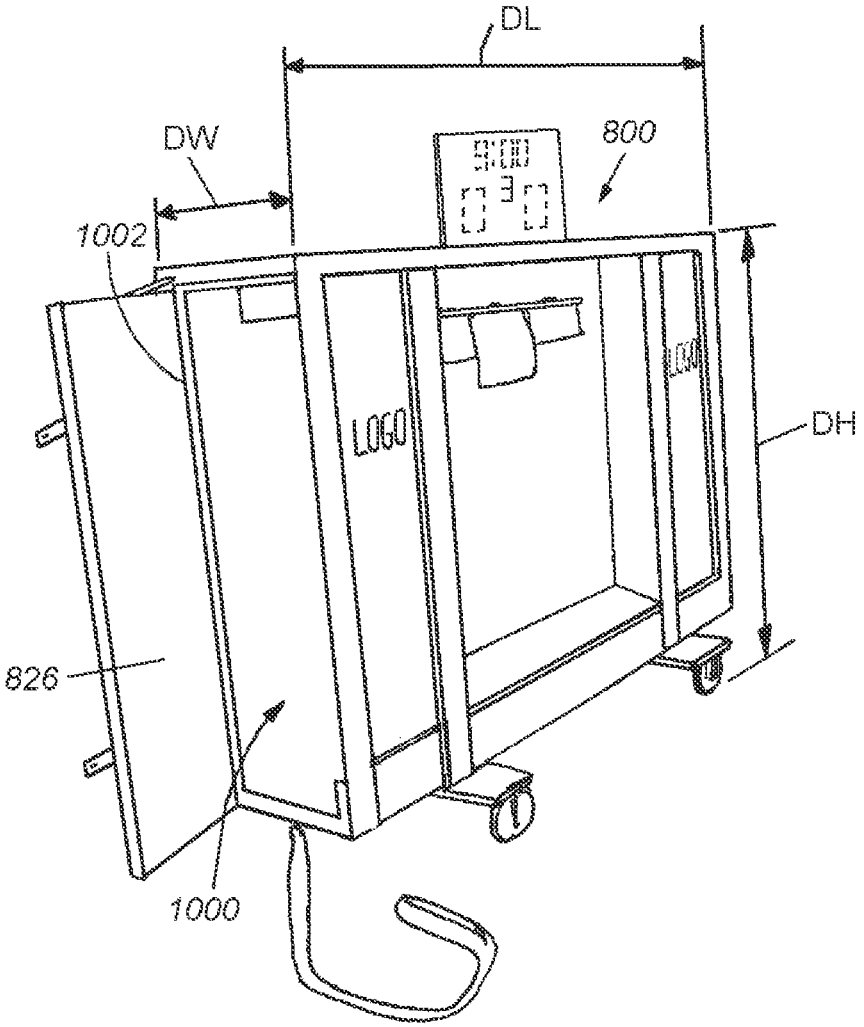
FIG. 10 is a end on perspective view of a universal dolly in an unloaded configuration, according to the illustrative embodiment.

FIG. 10 shows a dolly 800 in an unloaded configuration. An end door 826 is open, showing the interior 1000 and a hinge 1002. The dimensions of the illustrative dolly are proportioned to accommodate a disassembled strip. In an embodiment, the dolly height DH is approximately 6 feet (1.90 meters). The dolly length DL is 7 feet (2.10 meters) and the dolly width DW is 2 feet (0.70 meters). It should be obvious to one of ordinary skill that the universal dolly provides mobility for the disassembled strips, a storage container for the fencing strip and a readily available scoreboard and bulletin board for club and competitive events.

Figure 11:
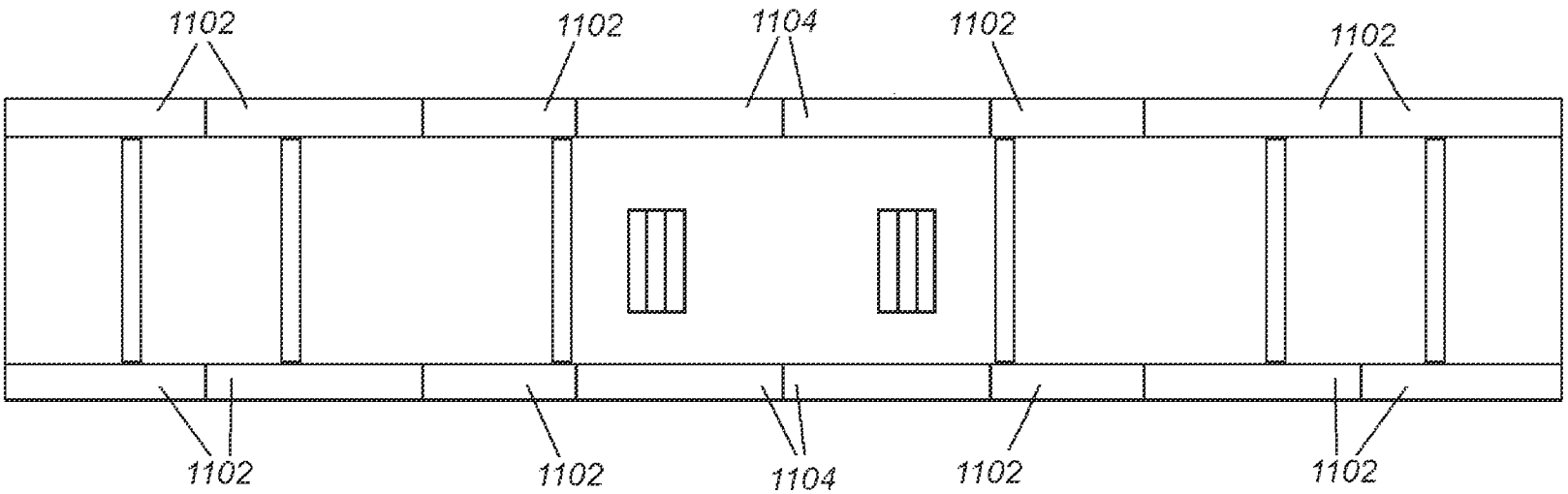
FIG. 11 is a top view of the illustrative selectable boundary fencing strip with sponsorship panels, according to an illustrative embodiment.

It has been observed that funding in the fencing community is problematic. The present invention addresses this problem by providing a mechanism for enhancing fundraising. The price of the fencing strip can be paid in a lump sum, by rental or as a deferred payment. In the lump sum model, a fencing organization raises money and purchases the strip outright. In FIG. 11, the fencing strip 700 can be provided with a plurality of side panels 1102 for advertising sponsorship. Interested parties can purchase or rent an advertising panel. In the illustrative embodiment, the fencing strip is constructed and arranged to have eight panels 1102 on each side. In other embodiments, this can be greater, and/or panels 1102 can be merged together. The panels can be of different sizes and the price of advertising can be based on panel sizes. Center panels 1104 can be provided with a greater value than panels further along the sides. Once a fencing organization has purchased the strip, it can rent the panels and keep the proceeds of sponsorship/advertising marketing to sustain organization activities. As stated above, the exterior surfaces of the universal dolly can also provide advertising space.

The fencing strip can be rented to an organization with an agreed-upon payment schedule that provides for set or variable payments over time. The organization can then market advertising on the open panels and keep funds in excess of the rent. Once the fencing strip is paid off, the organization can continue selling advertising and keep all of the proceeds. In another model, the fencing strip can be provided free without a pre-agreed rental contract and payment is deferred. The advertising/sponsorship is marketed by the organization with all of the revenues being forwarded to the manufacturer, until the fencing strip is paid off. After that, the organization keeps all of the proceeds. These models of providing the fencing strip enables various organizations to acquire and use the fencing strip while raising revenues that will eventually support the organization.

For example, tennis uses a half court, bowling includes optional bumper rails, golf shortens the drive by moving the tees and baseball's various sized fields and distances from pitcher's mounds to home plates. Fencing continues to use a standard fencing area that is 17 meters long by 1.5 meters wide, a space that tends to be too large for novice children aged 7-9 years. Younger athletes are observed to be moving too much side to side, with the results that their initial training is on a fencing strip that is both too long and too wide. A more realistic approach is to divide the athletes by age and size, and proportion the fencing strip area accordingly.

In an embodiment, three levels of fencers based on age and size are cadets (aged 7-9 and the smallest in stature), juniors (aged 10-15 and the middle-sized) and seniors (aged 16 or more years and the largest). The size of a standard fencing strip is 17 meters in length and 2 meters in width. The active area is approximately 14 meters long and 1.5 meters wide. This provides for a run off distance of approximately 1.5 meters at both ends and a 0.25 meter wide strip on either side (for sponsorship and other purposes, as set forth above). It is proposed that seniors can use 100 percent of the active area. Active areas for juniors are reduced in length by 20 percent, leaving an active area of approximately 11.20 meters in length. The junior width is unchanged. An active area for cadets is reduced in length by 20 percent and in width by 20 percent. The cadet active area is approximately 11.20 meters in length and approximately 1 meter wide. In other embodiments, the reductions of size can be greater or lesser for length and width.

Figure 12:
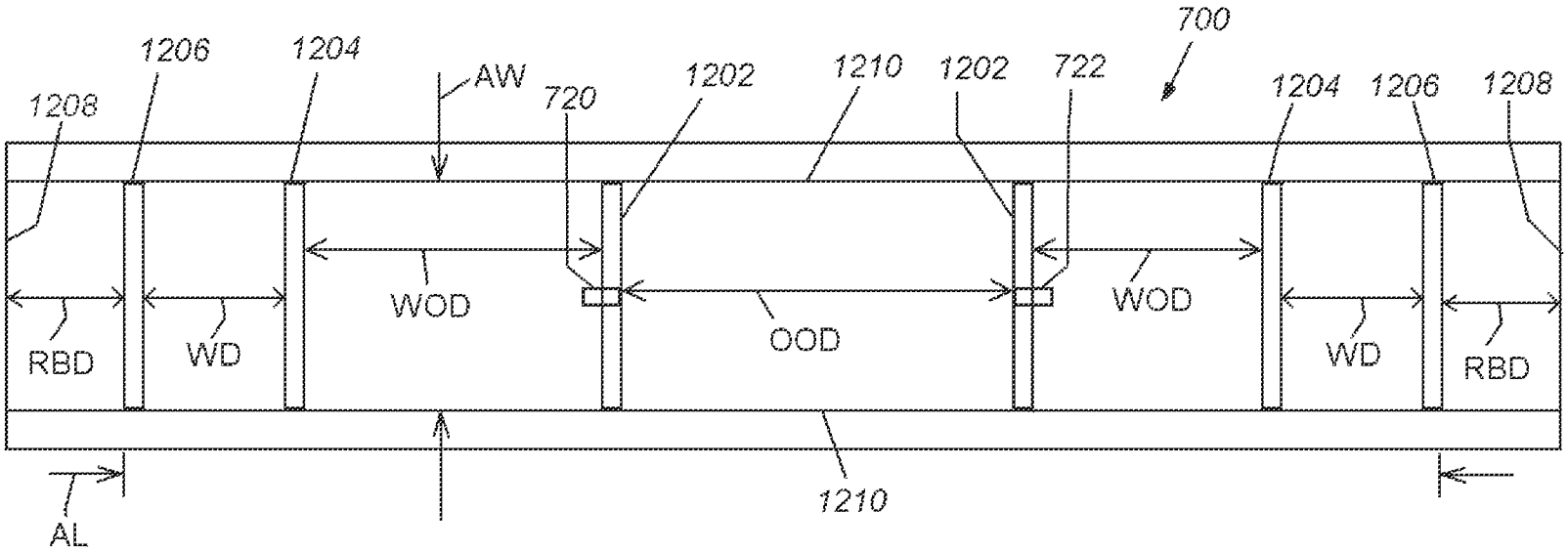
FIG. 12 is a top view of the illustrative selectable boundary fencing strip configured for a senior setting, according to the illustrative embodiment.

FIG. 12 depicts the illustrative strip 700 that is a senior-level strip with an active area length AL of 14 meters and an active area width AW of 1.5 meters. The settings are selectable and will change the distances and positions of the illuminated lines. The strip is provided with opposing en garde lines 1202, warning lines 1204, end lines 1206 and ends of the strip 1208. The distance OOD between the en garde lines 1202 is 4 meters. The distance WOD between the warning lines 1204 and the en garde lines 1202 is 3 meters. The distance WD between the end lines 1206 and the warning lines 1204 is 2 meters. The run off distance RBD between the end of the strip 1208 and the end line 1206 is 1.5 meters. These limits are delineated by lighting in the subsurface. In an embodiment, the side lines 1210 are illuminated in blue, the en garde lines 1202 in green, the warning lines 1204 in yellow and the end lines 1206 in red.

Figure 13:
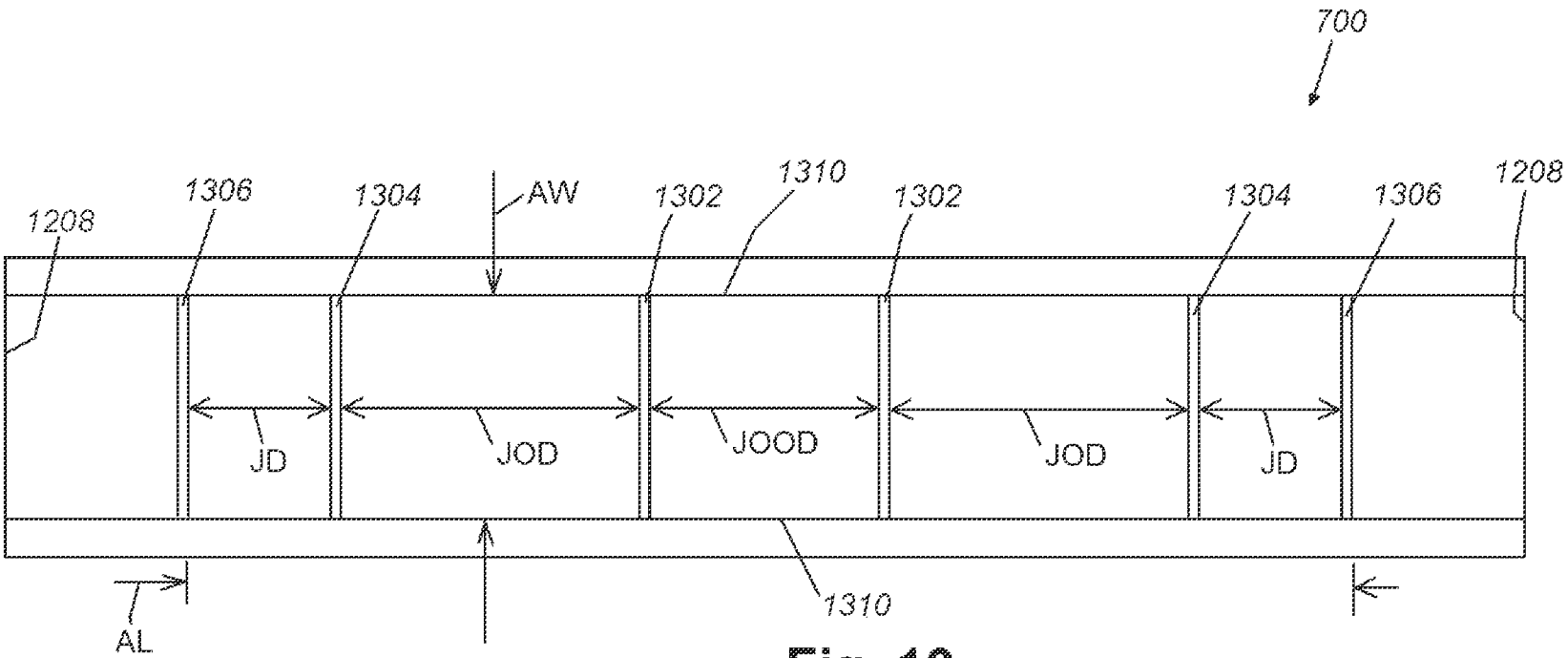
FIG. 13 is a top view of the illustrative selectable boundary fencing strip configured for a junior setting, according to the illustrative embodiment.

FIG. 13 depicts the illustrative strip 700 as configured for use by juniors. As stated above, this is arranged so that the overall active length AL is reduced by 20 percent to 11.20 meters and the active width AW is unchanged, at 1.5 meters. The respective lines are illuminated and pre-set so that the scorer enters the desired size into a master controller (not shown) and the lights illuminate the appropriate junior sized active area. All lengths have been proportionally reduced from the senior configuration, as noted in FIG. 12. The strip is provided with opposing junior en garde lines 1302, junior warning lines 1304, junior end lines 1306 and ends of the strip 1208. The distance JOOD between the en garde lines 1302 is 3.2 meters. The distance JOD between the junior warning lines 1304 and the en garde lines 1302 is 2.4 meters. The distance JD between the junior end lines 1306 and the warning lines 1304 is 1.6 meters. These limits are delineated by lighting in the subsurface.

Figure 14:
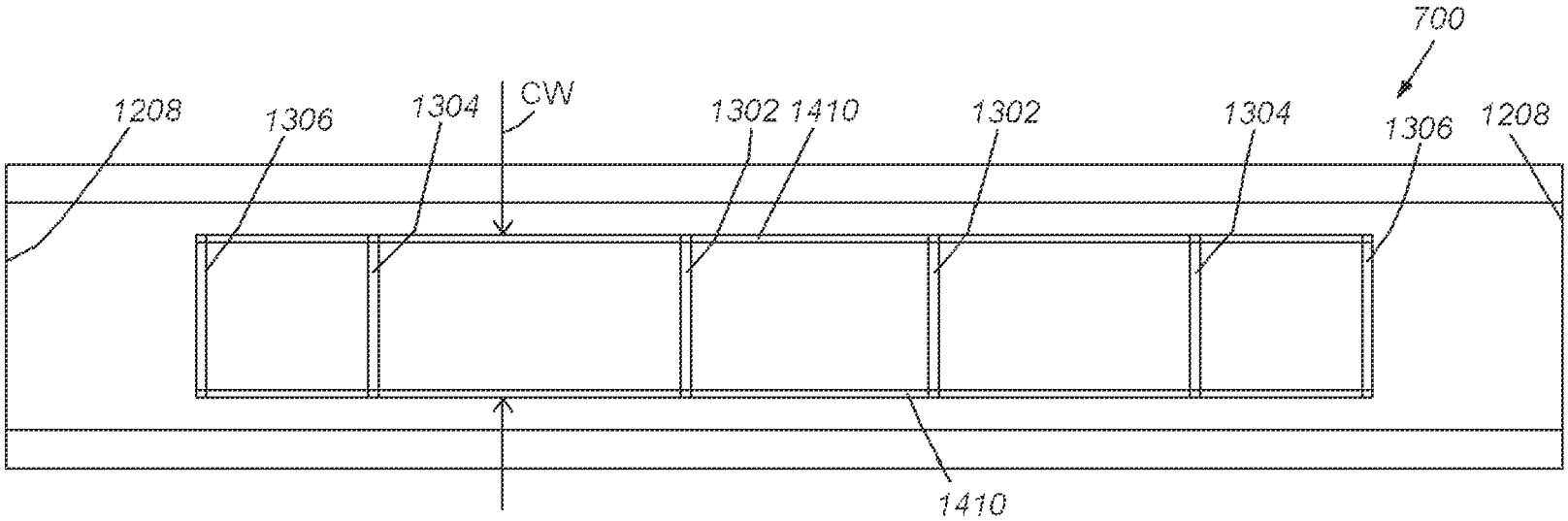
FIG. 14 is a top view of the illustrative selectable boundary fencing strip configured for a cadet setting, according to the illustrative embodiment.

FIG. 14 depicts the illustrative fencing strip 700 configured for cadet athletes. The cadet setting is an active are that is reduced by 20 percent in length to 11.20 meters from the seniors and 20 percent in width CW to approximately 1 meter from the seniors. The relative distances between lines 1302, 1304 and 1306 does not change from the juniors, as depicted in FIG. 14. The sidelines 1410 have been moved closer to each other so that their separation is approximately 1 meter. This movement of the sidelines is actuated by the scorer selecting the cadet setting, whereupon the illuminated sidelines move inward relative to each other.

The foregoing has been a detailed description of illustrative embodiments of the invention. Various modifications and additions can be made without departing from the spirit and scope if this invention. Each of the various embodiments described above can be combined with other described embodiments in order to provide multiple features. Furthermore, while the foregoing describes a number of separate embodiments of the apparatus and method of the present invention, what has been described herein is merely illustrative of the application of the principles of the present invention. For example, the size, shape and elevation the fencing strip of this invention is highly variable. In alternate embodiments, the strip can not need to be conductive, and light assemblies can be embedded therein using transparent windows that sit flush with the surrounding strip top surface. Likewise, in any of the embodiments herein, additional light colors or effects (e.g. flashing lights) can be used in conjunction with the embedded light assemblies described herein. In one example, lights can be made to flash for certain types of fouls, or additional lights in additional colors can be used to indicate fouls, certain types of touches or timeout. Using multi-color light arrays, these various colors can be accommodated without increasing the size of the light assembly's footprint within the strip. In alternate embodiments, the settings can be varied and the various line locations for age and size settings can be varied. Additional settings and active area dimensions can be provided for other groups of athletes, for example, wheel chair bound fencers. In another embodiment, the lighted selected boundaries can be variable set by the scorer. It is further contemplated that the universal dolly can be provided with a scoreboard mountable on the side of the dolly. The material of the dolly can vary. Accordingly, this description is meant to be taken only by way of example, and not to otherwise limit the scope of this invention.

What is claimed is:

1. A selectable boundary fencing strip comprising:

a plurality of segments of panels of similar size and shape, each provided with a conductive perforated top surface and supported by a plurality of support stringers;

a plurality of light sources located within each segment of panel, each being constructed and arranged to indicate each of a plurality of different scoring events, the light sources each being located beneath the conductive perforated top surface, the conductive top surface being perforated so that the light sources project through, and their light can be viewed through the perforations, the light sources being interconnected with a scoring control of the electronic scoring system; and a plurality of pre-set illuminated boundaries that can be selected and modified.

2. The selectable boundary fencing strip as set forth in claim 1 wherein the light sources in the strip are arranged to provide visual illumination cues for commencing to fence, warning cards and hits.

3. The selectable boundary fencing strip as set forth in claim 1 wherein the sides of the strip are provided with a plurality of panels for advertising sponsorship.

4. The selectable boundary fencing strip as set forth in claim 1 wherein the fencing strip provides a plurality of settings for athletes of various ages and sizes.

5. The selectable boundary fencing strip as set forth in claim 4 wherein the light sources are constructed and arranged to project at provide pre-set boundaries for the various settings for athletes of various sizes and ages.

6. The selectable boundary fencing strip as set forth in claim 4 wherein a senior setting describes an active area of 14 meters in length and 1.5 meters in width for a fencer over 16 years of age and of largest stature.

7. The selectable boundary fencing strip as set forth in claim 4 wherein a junior setting describes an active area of 11.20 meters in length and 1.5 meters in width for a fencer between the ages of 10 and 15 year and of middle stature.

8. The selectable boundary fencing strip as set forth in claim 4 wherein a cadet setting describes an active area of 11.20 meters in length and 1 meter in width for a fencer between the ages of 7 and 9 years and of smallest stature.

9. The selectable boundary fencing strip as set forth in claim 4 wherein each of a plurality of segments of panels can be provided with a panel that can be used to display information.

10. The selectable boundary fencing strip as set forth in claim 9 wherein the information displayed is advertising and sponsorship information.

* * * * *